US006397746B1

(12) United States Patent
Nakayama et al.

(10) Patent No.: US 6,397,746 B1
(45) Date of Patent: Jun. 4, 2002

(54) CAMERA-READY COPY SHEET FOR LITHOGRAPHIC PRINTING PLATES

(75) Inventors: Takao Nakayama; Seishi Kasai; Hiroyuki Ohishi, all of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/634,803

(22) Filed: Aug. 8, 2000

(30) Foreign Application Priority Data

| | | |
|---|---|---|
| Aug. 9, 1999 | (JP) | 11-225559 |
| Aug. 25, 1999 | (JP) | 11-238823 |
| Sep. 2, 1999 | (JP) | 11-248941 |

(51) Int. Cl.[7] ..... B41N 6/00
(52) U.S. Cl. ..... 101/375; 101/382.1
(58) Field of Search ..... 101/141, 217, 101/375, 376, 382.1, 389.1, 401, 401.3, 401.1, 413, 415.1, 453, 458, 459, 460, 462; 492/18, 30, 37

(56) References Cited

U.S. PATENT DOCUMENTS

| | | | | |
|---|---|---|---|---|
| 4,643,095 A | * | 2/1987 | Pfizenmaier et al. | 101/401.1 |
| 4,977,833 A | * | 12/1990 | Inage et al. | 101/415.1 |
| 5,511,476 A | * | 4/1996 | Banike et al. | 101/389.1 |
| 5,673,623 A | * | 10/1997 | Schmid | 101/415.1 |
| 5,775,225 A | * | 7/1998 | Saitou | 101/415.1 |
| 5,881,645 A | * | 3/1999 | Lenney et al. | 101/458 |
| 5,967,047 A | * | 10/1999 | Kuhn et al. | 101/459 |
| 6,105,500 A | * | 8/2000 | Bhambra et al. | 101/459 |
| 6,112,664 A | * | 9/2000 | Naniwa et al. | 101/463.1 |
| 6,176,182 B1 | * | 1/2001 | Nakayama et al. | 101/375 |

FOREIGN PATENT DOCUMENTS

| | | |
|---|---|---|
| EP | 246012 | * 11/1987 |
| EP | 896884 | * 2/1999 |
| JP | 11-20130 | 1/1999 |

* cited by examiner

*Primary Examiner*—Stephen R. Funk
(74) *Attorney, Agent, or Firm*—Reed Smith LLP

(57) ABSTRACT

The present invention provides for a camera-ready copy sheet to be inserted between a plate cylinder and a lithographic printing plate at least the back side of which is made of a non-metallic material. The copy sheet has asperities of a predetermined shape on the front side that are urged against the back side of the lithographic printing plate to depress it. These asperities are formed of projections that consist of at least two groups of particles. A larger particle group having a particle size larger than an intermediate between maximum and minimum particle sizes has an average size at least twice an average size of a smaller particle group having a particle size smaller than the intermediate. The sum per unit area of maximum cross-sectional areas of planes in the particles of the larger particle group that are parallel to the surface of the sheet ranges from 0.1% to 4% of the unit area.

4 Claims, 2 Drawing Sheets

CAMERA-READY COPY SHEET FOR LITHOGRAPHIC PRINTING PLATES

BACKGROUND OF THE INVENTION

1. Field of the Invention

The present invention relates to a camera-ready copy sheet for lithographic printing plates to prevent them from positionally offsetting on plate cylinders in a press.

2. Description of the Related Art

To perform printing with lithographic presses, a lithographic plate is wrapped around a plate cylinder and fixed mechanically.

Conventionally, when lithographic presswork is performed with plates having a non-metallic base on at least the back side as exemplified by a plastic film or paper (coated with a resin on both sides), the softness of the base tends to reduce the accuracy of the positions in which the plate is gripped on to the leading edge of the plate cylinder. If this phenomenon occurs, the accuracy of the plate in the vertical position (i.e., the accuracy in the around-the-cylinder direction) decreases and, in an extreme case, the plate may be fixed slantwise. As a further problem, the friction with the cylinder during printing causes partial distortion in the plate, eventually reducing the accuracy in position relative to the paper to be printed.

Under these circumstances, the use of lithographic plates having a non-metallic base on at least the back side has been limited to the case of short-run work where no problem is caused even if printed pieces have low accuracy in register. On the other hand, exquisite multi-color printing and long-run work on massive presses often fail to achieve the desired color register.

Platemaking and printing operations based on the computer-to-plate (CTP) technology have gained increasing acceptance these days. Compared to the conventional approaches (in which the plate material is subjected to contact exposure with a lith film), the new processes have the advantage of providing good dimensional and positional accuracy for the image (exposure) with respect to the plate material, as well as permitting easy registration in multi-color printing.

Of the two distinctive advantages of the CTP technology, the ease in registration for multi-color printing cannot be realized with lithographic plates based on non-metallic materials such as paper and plastics because they have the problems already described above.

In order to solve the above described problem, it has recently been proposed that a sheeting having an initial elastic modulus of no more than 300 kg/mm$^2$ should be inserted between the press plate and the plate cylinder [see Unexamined Published Japanese Patent Application (kokai) No. 11-20130)]. The sheet has fine particulate matter such as glass beads adhered and fixed thereto so that it has a center-line average roughness Ra of at least 2.

According to the publication, the sheet is prepared by adhering and fixing fine particulate matter such as glass beads onto the surface of a sheet material at high and uniform density. In other words, a highly concentrated liquid dispersion of fine particles is needed to form asperities on the sheeting.

Since the fine particulate matter of the type used in the patent is generally expensive, adhering and fixing it at high and uniform density inevitably increases the cost of the sheet. In addition, the fine particles cannot be easily dispersed in liquid at high concentration and, what is more, agglomeration often occurs in the highly concentrated dispersion and the resulting coarse particles will deteriorate the quality of printed matter.

SUMMARY OF THE INVENTION

It is an object of the present invention to provide a camera-ready copy sheet with which lithographic printing plates can be prevented from being positionally offset on a plate cylinder in a press. In the presence of such camera-ready copy sheet, lithographic plates using bases made of non-metallic materials can be applied to multi-color printing or long-run work. In addition, positional offset of plates can be suppressed by merely providing a small amount of particles of at least two different sizes and hardness values on the surface of the copy sheet and this contributes to both cost reduction and easy production. The larger particles have the added advantage of preventing positional offset from occurring between the lithographic plate and the camera-ready copy sheet before printing starts.

According to a first aspect of the present invention, in a camera-ready copy sheet to be inserted between a plate cylinder and a lithographic printing plate at least the back side of which is made of a non-metallic material, said copy sheet having asperities of a predetermined shape on the front side that are urged against the back side of the lithographic printing plate to depress it, the asperities being formed of projections that consist of at least two groups of particles; a larger particle group having a particle size larger than an intermediate between maximum and minimum particle sizes have an average size at least twice an average size of a smaller particle group having a particle size smaller than said intermediate, and the sum per unit area of maximum cross-sectional areas of planes in the particles of the larger particle group that are parallel to the surface of the sheet ranges from 0.1% to 4% of the unit area. This range is preferably in the range of 0.1 to 3.14%.

In the first aspect of the present invention, the sum per unit area of maximum cross-sectional areas of planes in the particles of the smaller particle group that are parallel to the surface of the sheet preferably ranges from 0.1% to 99.9% of the unit area. This range is preferably in the range of 3 to 80%.

In the following description, the larger particle group having the particle size larger than the intermediate are designated "the larger particles" and the smaller particle group having the particle size smaller than the intermediate are designated "the smaller particles", and the proportion of unit area that is occupied by the sum per unit area of maximum cross-sectional areas of planes in the particles that are parallel to the surface of the sheet is referred to as "occupied area percentage".

In the first aspect of the present invention, the larger particles preferably have an average diameter of 5–50 $\mu$m. If the larger particles have an average diameter of 50 $\mu$m, the smaller particles have an average diameter of no more than 25 $\mu$m. If the larger particles have an average diameter of 5 $\mu$m, the smaller particles have an average diameter of no more than 2.5 $\mu$m. In other words, if the larger particles have an average diameter of 5–50 $\mu$m, the smaller particles have an average diameter of no more than 25 $\mu$m, preferably in the range of 0.1–25 $\mu$m, more preferably in the range of 1.0–25 $\mu$m.

In the first aspect of the present invention, the projections that compose the asperities on the camera-ready copy sheet of the invention consist of two or groups of particles, the larger ones being fine inorganic particles such as glass beads or fine particles of comparatively hard polymers such as polystyrene. The smaller particles may be of the same materials as mentioned above; although they may be used in suitably selected amounts, their use is preferably minimized from the viewpoints of cost and production efficiency.

The amount of the smaller particles as relative to the larger particles is preferably in the range of ½ to 1000 times, more preferably 1–200 times, and most preferably 1–25 times, the amount of the larger particles.

If the larger particles are distributed coarsely to occupy 0.1–4% of unit area as set forth above, a comparatively small number of the larger particles suffice to achieve positive prevention of positional offset of lithographic plates on the plate cylinder. By using the smaller particles, the lower limit of the percent area that need be occupied by the larger particles to produce the stated effect is reduced to 0.1 (i.e., the number of the large particles that need be used is reduced) and, at the same, this provides ease in separating adjacent camera-ready copy sheets in a stack. If the larger particles occupy 0.1% of the unit area, the remaining part (99.9%) may be occupied by the smaller particles. The stated effect can be achieved if the smaller particles occupy at least 0.1% of the unit area.

To compute the occupied area percentage as defined herein, the surface of a sample is photographed with an optical microscope from right above, the number (n) of projecting particles in a predetermined area S ($\mu m^2$) is counted, and the occupied area percentage is calculated from the average diameter R ($\mu$m) of the particles by the following formula:

$$\text{Occupied area percentage}=[n\times(\pi R^2/4)/S]\times 100\ (\%).$$

The camera-ready copy sheet according to the first aspect of the present invention can effectively prevent positional offset of lithographic printing plates even if the large particles that constitute the projections of a predetermined shape on the surface of the sheet are as few as noted above. If they are urged against the back side of the lithographic plate, the latter is sufficiently depressed that the plate with which lithographic printing is being performed on a press can be positively prevented from being positionally offset on a plate cylinder primarily under the printing pressure.

As a further advantage, the camera-ready copy sheet is designed to urge against the back side of the printing plate in only limited areas so that unevenness in printing that may occur can be reduced to an amount that cause no problems in practical operations.

In the first aspect of the present invention, the back side of the lithographic plate may be depressed at the time when the camera-ready copy sheet is positioned between the lithographic plate and the plate cylinder while both the plate and the copy sheet are wrapped around the cylinder. Alternatively, it may not be until the printing pressure is applied after the copy sheet was positioned that the back side of the plate is depressed.

The lithographic printing plates that can be used in the present invention are not limited to any particular types and may be exemplified by common PS plates, plates having a silver diffusion type light-sensitive layer, and those prepared by electrophotographic platemaking processes.

According to a second aspect of the present invention, in a camera-ready copy sheet to be inserted between a plate cylinder and a lithographic printing plate at least the back side of which is made of a non-metallic material, said copy sheet having asperities of a predetermined shape on the front side that are urged against the back side of the lithographic printing plate to depress it, the asperities being formed of projections that consist of at least two groups of particles; a larger particle group having a particle size larger than an intermediate between maximum and minimum sizes have an average size at least twice an average size of particles of a smaller particle group having a particle size smaller than said intermediate, the larger particle group have a higher hardness than the smaller particle group, and the larger particle group forms projections with a height in the range of 5–50 $\mu$m.

In the second aspect of the present invention, the sum per unit area of maximum cross-sectional areas of planes in the larger particle group that are parallel to the surface of the sheet preferably preferably ranges from 0.05% to 4% of the unit area. This range is preferably in the range of 0.05 to 3.14%.

In the second aspect of the present invention, if the projections that compose the asperities on the camera-ready copy sheet of the invention are formed of the larger and smaller particles having different hardness values, the larger particles may be fine organic particles such as glass beads, grit particles and particulate inorganic compounds that have an average size of 5–50 $\mu$m and a Durometer hardness of at least 100, whereas the smaller particles may be polymer particles such as polyethylene particles that are less hard than the larger particles, typically having a Durometer hardness of 54–72. The smaller particles may be used in suitably selected amounts but from the viewpoints of cost and production efficiency, their use is preferably minimized.

The "Durometer hardness" as used herein is a hardness value obtained by measurement with Type A of a spring-loaded hardness meter called Durometer and manufactured by Shore, Inc., USA.

In the second aspect of the present invention, if the larger particles have an average size of 5–50 $\mu$m, the smaller particles have an average size of no more than 25 $\mu$m and if the larger particles have an average size of 5 $\mu$m, the smaller particles have an average size of no more than 2.5 $\mu$m.

In the second aspect of the present invention, the amount of the smaller particles as relative to the larger particles is preferably in the range of ½ to 1000 times, more preferably 1–200 times, and most preferably 1–25 times, the amount of the larger particles.

In the second aspect of the present invention, if the larger particles are distributed coarsely to occupy 0.05–4% of unit area as set forth above, a comparatively small number of the particles suffice to achieve positive prevention of positional offset of lithographic plates on the plate cylinder. The use of the smaller particles which are less hard than the larger particles provides ease in separating adjacent camera-ready copy sheets in a stack.

To compute the occupied area percentage as defined in the preferred embodiment of the invention, the surface of a sample is photographed with an optical microscope from right above, the number (n) of projecting particles in a predetermined area S ($\mu m^2$) is counted, and the occupied area percentage is calculated from the average diameter R ($\mu$m) of the particles by the following formula:

$$\text{Occupied area percentage}=[n\times(\pi R^2/4)/S]\times 100\ (\%).$$

The camera-ready copy sheet according to the second aspect of the present invention can effectively prevent positional offset of lithographic printing plates even if the large projections that constitute the asperities of a predetermined shape on the surface of the sheet are as few as noted above. If they are urged against the back side of the lithographic plate, the latter is sufficiently depressed that the plate with which lithographic printing is being performed on a press can be positively prevented from being positionally offset on a plate cylinder primarily under the printing pressure.

In the present invention, the back side of the lithographic plate may be depressed at the time when the camera-ready copy sheet is positioned between the lithographic plate and the plate cylinder while both the plate and the copy sheet are wrapped around the cylinder. Alternatively, it may not be until the printing pressure is applied after the copy sheet was positioned that the back side of the plate is depressed.

The lithographic printing plates that can be used in the invention are not limited to any particular types and may be exemplified by common PS plates, plates having a silver diffusion type light-sensitive layer, and those prepared by electrophotographic platemaking processes.

According to a third aspect of the present invention, in a camera-ready copy sheet to be inserted between a plate cylinder and a lithographic printing plate, said copy sheet having asperities of a predetermined shape on the front side, the asperities being formed of projections that comprising at least two particle groups; a larger particle group having a particle size larger than the intermediate between maximum and minimum sizes have an average size at least twice an average size of a smaller particle group having a particle size smaller than said intermediate, the larger particle group have a Durometer hardness of 65 or less which is lower than that of the smaller particle group, the larger particle group forms projections with a height in the range of 5–200 $\mu$m; and the sum per unit area of maximum cross-sectional areas of planes in the larger particle group that are parallel to the surface of the sheet ranges from 0.1% to 4% of the unit area.

In the third aspect of the present invention, the sum per unit area of maximum cross-sectional areas of planes in the smaller particle group that are parallel to the surface of the sheet preferably ranges from 0.1% to 99.9% of the unit area.

The size of the smaller particles is preferably in the range of 1.0–100 $\mu$m, more preferably in the range of 1.0–25 $\mu$m.

The larger particles have a Durometer hardness of no more than 65 and because of their viscoelasticity, they produce great enough friction with the back side of the camera-ready copy to prevent positional offset of the printing plate.

Since they are harder than the larger particles, the smaller particles adhere tightly to the base of the camera-ready copy and, at the same time, they surround and stick to the larger particles to prevent deformation of the latter; in addition, the smaller particles prevent the larger particles from being dislodged during printing.

The camera-ready copy sheet of the invention has projections of different sizes and hardness values provided on the surface and features not only high resistance against uneven printing that is manifested as spots of ink smudge but also low cost and good production efficiency.

In the present invention, the sum per unit area of maximum cross-sectional areas of planes in the first group of particles that are parallel to the surface of the sheet ranges from 0.1% to 4% of the unit area, preferably from 0.1% to 3.14% of the unit area. In the following description, the proportion of unit area that is occupied by the sum per unit area of maximum cross-sectional areas of planes in the particles that are parallel to the surface of the sheet is sometimes referred to as "occupied area percentage".

In the present invention, the projections being comprised of the second group of particles preferably occupy 0.1–99.9% of the unit area.

The "Durometer hardness" as used herein is a hardness value obtained by measurement with Type A of a spring-loaded hardness meter called Durometer and manufactured by Shore, Inc., USA.

The projections that compose the asperities on the camera-ready copy sheet of the invention consist of two or groups of particles, the larger ones being fine inorganic particles such as glass beads or fine particles of comparatively hard polymers such as polystyrene. The smaller particles may be of the same materials as mentioned above; although they may be used in suitably selected amounts, their use is preferably minimized from the viewpoints of cost and production efficiency.

The amount of the smaller particles as relative to the larger particles is preferably in the range of ½ to 1000 times, more preferably 1–200 times, and most preferably 1–25 times, the amount of the larger particles.

If the larger particles are distributed coarsely to occupy 0.1–4% of unit area as set forth above, a comparatively small number of the larger particles suffice to achieve positive prevention of positional offset of lithographic plates on the plate cylinder.

To compute the occupied area percentage as defined herein, the surface of a sample is photographed with an optical microscope from right above, the number (n) of projecting particles in a predetermined area S ($\mu m^2$) is counted, and the occupied area percentage is calculated from the average diameter R ($\mu$m) of the particles by the following formula:

$$\text{Occupied area percentage}=[n\times(\pi R^2/4)/S]\times 100\ (\%).$$

The camera-ready copy sheet of the invention can effectively prevent positional offset of lithographic printing plates even if the large particles that constitute the projections of a predetermined shape on the surface of the sheet are as few as noted above; if they are urged against the back side of the lithographic plate, their viscoelasticity creates sufficient friction to make them adhere tightly to the lithographic printing plate. As a result, the plate with which lithographic printing is being performed on a press can be positively prevented from being positionally offset on a plate cylinder primarily under the printing pressure.

In the present invention, the camera-ready copy sheet may be urged against the back side of the lithographic plate at the time when it is positioned between the lithographic plate and the plate cylinder while both the plate and the copy sheet are wrapped around the cylinder. Alternatively, it may not be until the printing pressure is applied after the copy sheet was positioned that it is urged against the back side of the plate.

The lithographic printing plates that can be used in the invention are not limited to any particular types and may be exemplified by common PS plates, plates having a silver diffusion type light-sensitive layer, and those prepared by electrophotographic platemaking processes.

DETAILED DESCRIPTION OF THE INVENTION

Figure 1:
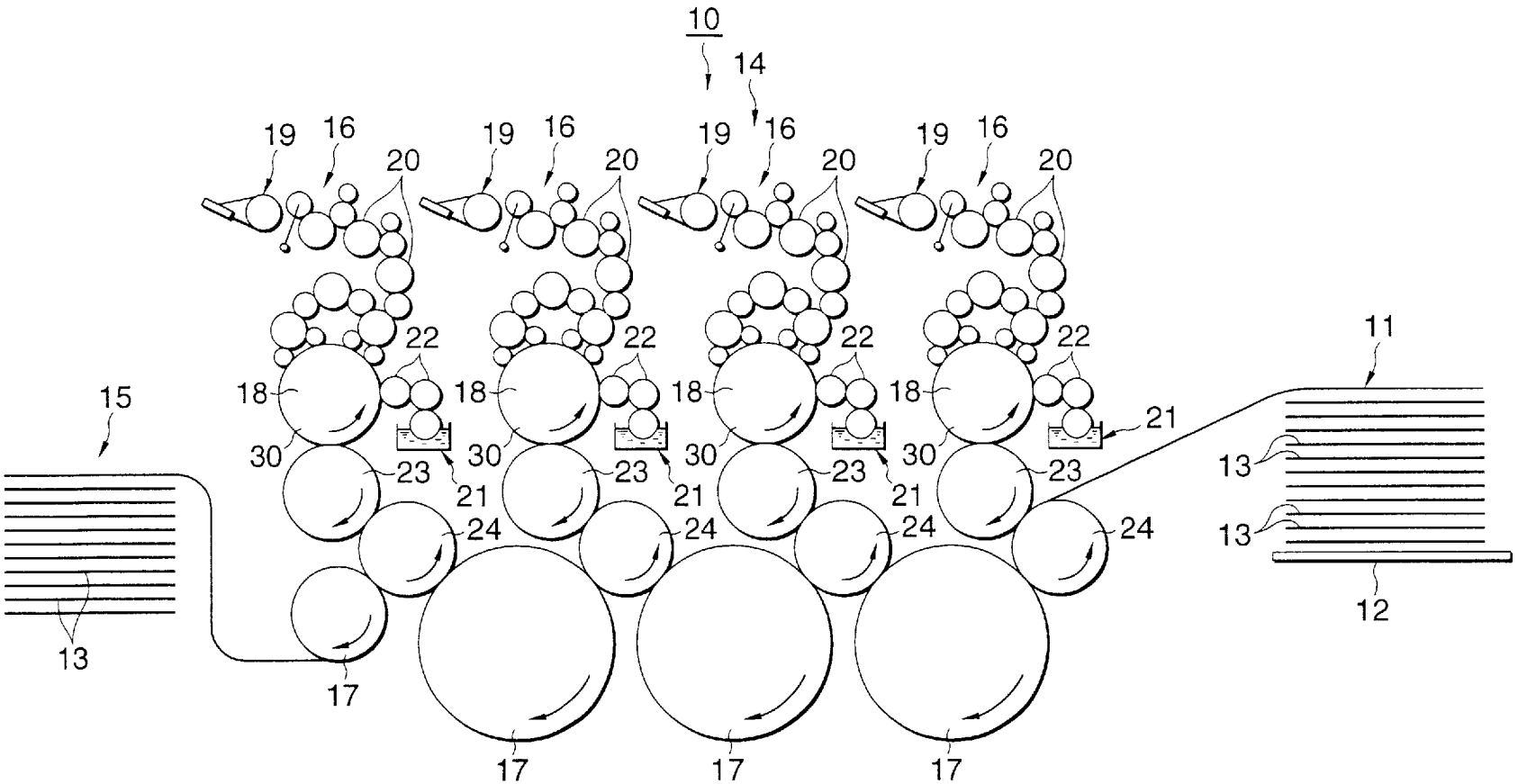
FIG. 1 is a schematic side view of a multicolor lithographic printing press employing a camera-ready copy sheet for lithographic plates according to an embodiment of the invention.

The present invention will be described in detail as follows.

First Embodiment

One method to form asperities on the surface of the base of the camera-ready copy sheet is by fixing groups of particles such as glass that are harder than the base of the lithographic plate such that a group of particles having a larger size than the intermediate between maximum and minimum sizes have an average size at least twice the average size of a group of particles having a smaller size than the intermediate.

Specific examples of this method of forming asperities on the surface of the copy sheet are as follows: a dispersion of the particles in a binder is applied to the base and then dried; after a binder film is formed, the particles are pushed into the film under mechanical pressure; the particles are electrodeposited after the binder film was formed.

The camera-ready copy sheet of the present invention may use any base materials that have good fit to the plate cylinder, as exemplified by plastics (e.g. polyethylene terephthalate, polypropylene and polyethylene), metals (e.g. aluminum and SUS), paper (e.g. natural or synthetic paper), and cloths. These bases preferably have a thickness in the range of 30–500 μm.

The camera-ready copy sheet can be fixed to the plate cylinder by means of an adhesive layer that is provided on the back side of the copy sheet. The adhesive layer may be formed of any suitable adhesive such as sprayed glue or double-coated tape. Alternatively, both the leading and trailing edges of the copy sheet may be brought into direct engagement with clamps in the surface of the plate cylinder. If desired, the two methods may be combined.

We now describe the manner of carrying out the invention in the mode under consideration. Before printing on a lithographic press, the respective plates are mounted on the plate cylinders in the associated printing units with the camera-ready copy sheet interposed. Each of the intervening copy sheets is urged against the back side of the press plate to depress it by the projections forming the asperities on the surface of the copy base. In consequence, each copy sheet not only adjusts the printing pressure being exerted by the blanket cylinder and the impression cylinder but also prevents positional offset of the press plate on the plate cylinder under pressure.

We next describe the method of preventing positional offset of the press plate. The camera-ready copy sheet having asperities of a predetermined shape formed on the surface of the base is interposed between the plate and the plate cylinder in each printing unit in such a way that the asperities are urged against the back side of the plate, whereupon the latter is depressed in conformity with the asperities.

EXAMPLE 1

Samples of the camera-ready copy sheet according to the embodiment of the invention and samples having asperities formed under conditions outside the scope of the invention were set on a lithographic press and printing was performed to evaluate the positional offset that occurred to the press plate on the plate cylinder. The specific conditions for copy sheet preparation and presswork and their results are set forth below.

Examples

The surface of a polyethylene terephthalate (PET) base 100 μm thick was roller coated with a homogenized dispersion of the recipe indicated below. These gave samples of the copy sheet according to the embodiment which had high areas formed on the surface from glass beads. The glass beads (GB 731 of Toshiba Glass Co., Ltd.) were classified to a size range of 1.5–60 μm with a powder centrifuge and the larger particles having an average size of 3, 5, 20, 40, 50 or 60 μm were mixed with an equal amount or ten volumes of the smaller particles which were one half the size of the larger particles. An acrylic resin was used as a binder. In the first place, the larger particles were used in such proportions (X) that they would occupy certain percentages of the unit area within the claimed range; to the thus prepared recipes, the smaller particles were added accordingly.

| | |
|---|---|
| Glass beads: Larger particles (Average diameter) | X g |
| 3 μm | 0.1 g |
| 5 μm | 0.1 g |
| 20 μm | 0.2 g |
| 40 μm | 0.2 g |
| 50 μm | 0.3 g |
| 60 μm | 0.3 g |
| Glass beads: Smaller particles (Average diameter) (Mixed in equal amount to X)(Example) | |
| 1.5 μm | 0.1 g |
| 2.5 μm | 0.1 g |
| 10 μm | 0.2 g |
| 20 μm | 0.2 g |
| 25 μm | 0.3 g |
| 30 μm | 0.3 g |
| (Mixed in an amount 10 times X) (Example) | |
| 1.5 μm | 1 g |
| 2.5 μm | 1 g |
| 25 μm | 3 g |
| 30 μm | 3 g |
| Acrylic resin (40% in toluene) | 20 g |
| Toluene | 80 g |

The press plate was prepared by a dedicated platemaker SPM 415 from Super Master Plus of AGFA-Gevaert AG which was a silver diffusion type light-sensitive material using a PET base 100 μm thick. The plate had a total thickness of 130 μm. The press plate may be replaced by a PS plate having an image-receiving layer on a non-metallic base or an electrophotographically made plate.

The copy sheet and the press plate were each cut to a width of 560 mm and a length of 400 mm and placed one on the other so that the roughened surface of the copy sheet was in contact with the back side of the press plate. The assembly of the copy sheet and the press plate was mounted on the plate cylinder of Oliver 52 (non-perfecting or one-side printing press of Sakurai Co., Ltd.) to print ruled lines on 2000 sheets of paper.

Prior to printing, the surface of the press plate was squeegeed with sponge impregnated with processing solution G671c. The dampening water on the press was a 1:1 aqueous dilution of G671c. The ink was New Champion F Gloss 85 of DAINIPPON INK AND CHEMICALS, INC.

The initial positions of the ruled lines were compared with those on the last printed paper to evaluate the positional offset that had occurred to the press plate on the plate cylinder during 2000 impressions.

Comparative Examples

On the surface of a polyethylene terephthalate (PET) base 100 μm thick similar to the above Examples, respective particles having the particle diameter of 5, 20, 40 and 50 μm were used to thereby prepare respective copy sheets. Thus obtained copy sheets were subjected to printing of 2000 sheets of paper in the same manner as the above Example.

The results of evaluation are shown in Tables 1 and 2 below. In each of the columns in the table, the evaluation for "plate offset" is noted on the left side, that for "uneven printing" in the middle, and that for "ease in correcting the position" on the right side. The data for Example 1 of the invention are bounded by a rectangle in thick lines.

The data in tables 1 and 2 were obtained by the following criteria for evaluation.

Evaluation Criteria

Plate offset: ◎ (<30 μm), ○ (30 μm to less than 50 μm), Δ (50 μm to less than 100 μm), × (≧100 μm)

Uneven printing: ◎ (no unevenness), ○ (slight unevenness), Δ (extensive unevenness), × (very extensive unevenness)

Ease in correcting the position: ◎ (very easy), ○ (easy), Δ (somewhat difficult), × (difficult)

The unevenness in printing that was evaluated on the printed matter in addition to the plate offset may reasonably be taken to occur by the following mechanism: any coarse particles on the copy sheet interposed between the press plate and the plate cylinder deform the soft plate base material such as PET during printing so that the surface of the deformed area of the press plate is raised to cause scumming in spots, which is recognized as "uneven print" on the printed matter.

TABLE 1

| The Smaller Particles Added in Equal | | | | | | |
|---|---|---|---|---|---|---|
| Occupied area percentage | Larger Particle's diameter (μm) | | | | | |
| (%) | 3 | 5 | 20 | 40 | 50 | 60 |
| 0.05 | ×○× | ×○× | ×○Δ | Δ○○ | Δ○○ | ○×○ |
| 0.1 | ×○× | ◎◎◎ | ◎◎◎ | ◎◎◎ | ◎◎◎ | ○×○ |
| 1.0 | ×○× | ◎◎◎ | ◎◎◎ | ◎◎◎ | ◎◎◎ | ○×○ |
| 2.0 | ×○× | ◎◎◎ | ◎◎◎ | ◎◎◎ | ◎◎◎ | ○×○ |
| 3.14 | ×○× | ◎◎◎ | ◎◎◎ | ◎◎◎ | ◎◎◎ | ○×○ |
| 4.0 | ×○Δ | ○○○ | ○○○ | ○○○ | ○○○ | ○×○ |
| 6.0 | ×○Δ | ○Δ○ | ○Δ○ | ○×○ | ○×○ | ○×○ |
| 10.0 | ×○Δ | ○○Δ | ○○Δ | ○×○ | ○×○ | ○×○ |

As is clear from the data in Table 1 showing the case where the larger particles having a size of 5–50 μm were combined with an equal amount of the smaller particles, satisfactory results were obtained when the occupied area percentage for the larger particles was within the range of 0.1–4.0 %, since the plate offset was no more than 50 μm, no unevenness in printing occurred and it was easy to correct the plate position. Particularly, good results were obtained when the occupied area percentage for the larger particles was within the range of 0.05–3.14%, since the plate offset was less than 30 μm, no unevenness in printing occurred and it was very easy to correct the plate position. Accordingly, if the larger particles are combined with an equal amount of the smaller particles, it is possible to perform good printing even if the amount of the larger particles are small. In addition, it is easy to separate adjacent camera-ready copy sheets, thereby preventing the sheets from a plural-sheet feeding.

TABLE 2

| The Smaller Particles Added in Ten Volumes (Example) | | | | | | |
|---|---|---|---|---|---|---|
| Occupied area percentage | Larger Particle's diameter (μm) | | | | | |
| (%) | 3 | 5 | 20 | 40 | 50 | 60 |
| 0.05 | ×○× | ×○× | ×○× | Δ○○ | Δ○○ | ○×○ |
| 0.1 | ×○× | ◎◎◎ | ◎◎◎ | ◎◎◎ | ◎◎◎ | ○×○ |
| 1.0 | ×○× | ◎◎◎ | ◎◎◎ | ◎◎◎ | ◎◎◎ | ○×○ |
| 2.0 | ×○× | ◎◎◎ | ◎◎◎ | ◎◎◎ | ◎◎◎ | ○×○ |
| 3.14 | ×○× | ◎◎◎ | ◎◎◎ | ◎◎◎ | ◎◎◎ | ○×○ |
| 4.0 | ×○Δ | ○○○ | ○○○ | ○○○ | ○○○ | ○×○ |
| 6.0 | ×○Δ | ○Δ○ | ○×○ | ○×○ | ○×○ | ○×○ |
| 10.0 | ×○Δ | ○×Δ | ○×○ | ○×○ | ○×○ | ○×○ |

As is clear from the data in Table 2 showing the case where the larger particles having a size of 5–50 μm were combined with ten volumes of the smaller particles, satisfactory results were obtained when the occupied area percentage for the larger particles was within the range of 0.1–4.0%, since the plate offset was no more than 50 μm, no unevenness in printing occurred and it was easy to correct the plate position. Particularly good results were obtained when the occupied area percentage for the larger particles was within the range of 0.1–3.14%, since the plate offset was no less than 30 μm, no unevenness in printing occurred and it was very easy to correct the plate position. Accordingly, if the larger particles are used in combination with ten volumes of the smaller particles, satisfactory printing can be accomplished with a small number of the larger particles. In addition, it is easy to separate adjacent camera-ready copy sheets, thereby preventing the sheets from a plural-sheet feeding.

The data in Tables 1 and 2 suggest that comparable results will be obtained if the smaller particles are added in amounts ranging from 1 to 10 times the amount of the larger particles.

On the other hand, in the Comparative Examples, the copy sheets using respective particles having the particle diameter of 5, 20, 40 and 50 μm did not satisfy the level of ◎ regarding to the plate offset, uneven printing and ease in correcting the position.

Particularly, the copy sheet using the particles having the particle diameter of 5 μm is large in the plate offset, and the copy sheet using the particle having the particle diameter of 50 μm is much in uneven printing. Both sheets were hard for practical use.

In the next experiment, varied was the occupied area percentage for the smaller particles and evaluated its effect on the ease with which adjacent camera-ready copy sheets in a stack could be separated. The results are shown in Table 3 by the following criteria for rating: ◎, very good; ○, good; ×, poor. The data for the Example of the invention are bounded by a rectangle in thick lines.

TABLE 3

| Ease of Separating Adjacent Camera-Ready Copy Sheets in a Stack | | | | | | |
|---|---|---|---|---|---|---|
| Occupied area | Smaller particle's diameter, μm | | | | | |
| percentage (%) | 1.5 | 2.5 | 10 | 20 | 25 | 30 |
| 0.05 | × | × | × | × | × | × |
| 0.1 | ○ | ○ | ○ | ○ | ○ | × |
| 3.0 | ◎ | ◎ | ◎ | ◎ | ◎ | × |
| 80.0 | ◎ | ◎ | ◎ | ◎ | ◎ | × |
| 99.9 | ○ | ○ | ○ | ○ | ○ | × |

As Table 3 shows, adjacent camera-ready copy sheets in a stack could be easily separated when the smaller particles had an average size of 1.5–25 μm and occupied 0.1–99.9% of the unit area. The separation was quite easy when the occupied area percentage was between 3 and 80%. On the other hand, adjacent camera-ready copy sheets in a stack could not be easily separated when the smaller particles had an average size of 30 μm and occupied 0.05% of the unit area. It is therefore clear that if the smaller particles having an average size of no more than 25 μm are additionally used to occupy 0.1–99.9%, preferably 30–80%, of the unit area, adjacent camera-ready copy sheets in a stack can be easily separated, thereby preventing unwanted feeding of two or more copy sheets.

From the foregoing results, it can be seen that prevention of plate offsets and uneven printing (smudge in the non-image area), ease of correction of the plate position and ease of separation of adjacent copy sheets in a stack can be accomplished by a camera-ready copy sheet to be inserted between a plate cylinder and a lithographic printing plate at least the back side of which is made of a non-metallic material, said copy sheet having asperities of a predetermined shape on the front side that are urged against the back side of the lithographic printing plate to depress it, the asperities being formed of projections that consist of at least two groups of particles, characterized in that the particles of a larger size than the intermediate between maximum and minimum sizes have an average size at least twice the average size of the particles of a smaller size than said intermediate and that the sum per unit area of maximum cross-sectional areas of planes in the first group of particles that are parallel to the surface of the sheet ranges from 0.1% to 4% of the unit area.

Second Embodiment

One method to form asperities on the surface of the base of the camera-ready copy sheet is by fixing groups of particles such as glass that are harder than the base of the lithographic plate. In this case, although smaller particles as polymer particles having lower hardness are also formed with larger particles, the smaller particles are not necessary to be harder than the back of the base.

Specific examples of this method of forming asperities on the surface of the copy sheet are as follows: a dispersion of the particles in a binder is applied to the base and then dried; after a binder film is formed, the particles are pushed into the film under mechanical pressure; the particles are electrodeposited after the binder film was formed.

The camera-ready copy sheet of the invention may use any base materials that have good fit to the plate cylinder, as exemplified by plastics (e.g. polyethylene terephthalate, polypropylene and polyethylene), metals (e.g. aluminum and SUS), paper (e.g. natural or synthetic paper), and cloths.

The camera-ready copy sheet can be fixed to the plate cylinder by means of an adhesive layer that is provided on the back side of the copy sheet. The adhesive layer may be formed of any suitable adhesive such as sprayed glue or double-coated tape. Alternatively, both the leading and trailing edges of the copy sheet may be brought into direct engagement with clamps in the surface of the plate cylinder. If desired, the two methods may be combined.

We now describe the manner of carrying out the invention. Before printing on a lithographic press, the respective plates are mounted on the plate cylinders in the associated printing units with the camera-ready copy sheet interposed. Each of the intervening copy sheets is urged against the back side of the press plate to depress it by the projections forming the asperities on the surface of the copy base.

In consequence, each copy sheet not only adjusts the printing pressure being exerted by the blanket cylinder and the impression cylinder but also prevents positional offset of the press plate on the plate cylinder under pressure.

We next describe the method of preventing positional offset of the press plate. The camera-ready copy sheet having asperities of a predetermined shape formed on the surface of the base is interposed between the plate and the plate cylinder in each printing unit in such a way that the asperities are urged against the back side of the plate, whereupon the latter is depressed in conformity with the asperities.

EXAMPLE 2

Samples of the camera-ready copy sheet according to the embodiment of the invention under consideration and samples having asperities formed under conditions outside the scope of the invention were set on a lithographic press and printing was performed to evaluate the positional offset that occurred to the press plate on the plate cylinder. The specific conditions for copy sheet preparation and presswork and their results are set forth below.

Examples

The surface of a polyethylene terephthalate (PET) base 100 μm thick was roller coated with a homogenized dispersion of the recipe indicated below. These samples of the copy sheet according to the embodiment which had high areas formed on the surface from glass beads. The glass beads (Durometer hardness: 100 or more; GB 731 of Toshiba Glass Co., Ltd.) were classified to a size range of 3–60 μm with a powder centrifuge to obtain the larger particles having an average size of 3, 5, 20, 40, 50 or 60 μm. The smaller particles having the half particle size of the larger particles were prepared by classifying low density polyethylene spherical particles (Durometer hardness: 70, Sumitomo Seika Chemicals Co., Ltd.: Flowbeads LE2080) to a size range of 1.5–30 μm. In the first place, the larger particles were used in such proportions (X) that they would occupy certain percentages of the unit area within the claimed range; to the thus prepared recipes, the smaller particles were added accordingly. Prepared were mixtures in which the larger particles were mixed with an equal amount or ten volumes of the smaller particles. Then, they were subjected to ultrasonic dispersion to thereby obtain coating liquids. An acrylic resin was used as a binder.

| Recipe | |
|---|---|
| Glass beads: Larger particles (Average diameter) | X g |
| 3 μm | 0.1 g |
| 5 μm | 0.1 g |
| 20 μm | 0.2 g |
| 40 μm | 0.2 g |
| 50 μm | 0.3 g |
| 60 μm | 0.3 g |
| Glass beads: Smaller particles (Average diameter) (Mixed in equal amount to X)(Example) | |
| 1.5 μm | 0.1 g |
| 2.5 μm | 0.1 g |
| 10 μm | 0.2 g |
| 20 μm | 0.2 g |
| 25 μm | 0.3 g |
| 30 μm | 0.3 g |
| (Mixed in an amount 10 times X) (Example) | |
| 1.5 μm | 1 g |
| 2.5 μm | 1 g |
| 10 μm | 2 g |
| 20 μm | 2 g |
| 25 μm | 3 g |
| 30 μm | 3 g |
| Acrylic resin (40% in toluene) | 20 g |
| Toluene | 80 g |

The press plate was prepared by a dedicated platemaker SPM 415 from Super Master Plus of AGFA-Gevaert AG which was a silver diffusion type light-sensitive material using a PET base 100 μm thick. The plate had a total thickness of 130 μm. The press plate may be replaced by a PS plate having an image-receiving layer on a non-metallic base or an electrophotographically made plate.

The copy sheet and the press plate were each cut to a width of 560 mm and a length of 400 mm and placed one on the other so that the roughened surface of the copy sheet was in contact with the back side of the press plate. The assembly was mounted on the plate cylinder of Oliver 52 (non-perfecting or one-side printing press of Sakurai Co., Ltd.) to print ruled lines on 2000 sheets of paper.

Prior to printing, the surface of the press plate was squeegeed with sponge impregnated with processing solution G671c. The dampening water on the press was a 1:1 aqueous dilution of G671c. The ink was New Champion F Gloss 85 of DAINIPPON INK AND CHEMICALS, INC.

The initial positions of the ruled lines were compared with those on the last printed paper to evaluate the positional offset that had occurred to the press plate on the plate cylinder during 2000 impressions.

Comparative Examples 2-1

A camera-ready copy sheet was fabricated as in Examples, except that the larger particles were made of polyethylene and adjusted to have the same Durometer hardness as the smaller particles. The copy sheet was then subjected to press work as in Example 1.

Comparative Examples 2-2

A camera-ready copy sheet was fabricated as in Examples, except that the smaller particles had an average size greater than one half the average size of the larger particles. The copy sheet was then subjected to press work as in Example 1.

The results of evaluation are shown in Tables 4 and 5 below. In each of the columns in the table, the evaluation for "plate offset" is noted on the left side, that for "uneven printing" in the middle, and that for "ease in correcting the position" on the right side. The data for Example 1 of the invention are bounded by a rectangle in thick lines.

The data in tables 4 and 5 were obtained by the following criteria for evaluation.

(Evaluation Criteria)

Plate offset: ◎ (<30 μm), ○ (30 μm to less than 50 μm), Δ (50 μm to less than 100 μm), × (24 100 μm)

Uneven printing: ◎ (no unevenness), ○ (slight unevenness), Δ (extensive unevenness), × (very extensive unevenness)

Ease in correcting the position: ◎ (very easy), ○ (easy), Δ (somewhat difficult), × (difficult)

The unevenness in printing that was evaluated on the printed matter in addition to the plate offset may reasonably be taken to occur by the following mechanism: any coarse particles on the copy sheet interposed between the press plate and the plate cylinder deform the soft plate base material such as PET during printing so that the surface of the deformed area of the press plate is raised to cause scumming in spots, which is recognized as "uneven print" on the printed matter.

TABLE 4

| Occupied area percentage | The Smaller Particles Added in Equal — Larger Particle's diameter (μm) | | | | | |
|---|---|---|---|---|---|---|
| (%) | 3 | 5 | 20 | 40 | 50 | 60 |
| 0.03 | ×○× | Δ○× | Δ○Δ | Δ○○ | Δ○○ | ××× |
| 0.05 | Δ○× | ◎◎◎ | ◎◎◎ | ◎◎◎ | ◎◎◎ | ○×○ |
| 0.1 | Δ○× | ◎◎◎ | ◎◎◎ | ◎◎◎ | ◎◎◎ | ○×○ |
| 1.0 | Δ○× | ◎◎◎ | ◎◎◎ | ◎◎◎ | ◎◎◎ | ○×○ |
| 2.0 | Δ○× | ◎◎◎ | ◎◎◎ | ◎◎◎ | ◎◎◎ | ○×○ |
| 3.14 | Δ○× | ◎◎◎ | ◎◎◎ | ◎◎◎ | ◎◎◎ | ○×○ |
| 4.0 | Δ○Δ | ○○○ | ○○○ | ○○○ | ○○○ | |
| 6.0 | Δ○Δ | ○Δ○ | ○Δ○ | ○Δ○ | ○×○ | ○×○ |

As is clear from the data in Table 4 showing the case where the larger particles having a size of 5–50 μm were combined with an equal amount of the smaller and less hard particles, satisfactory results were obtained when the occupied area percentage for the larger particles was within the range of 0.05–4.0%, since the plate offset was no more than 50 μm, no unevenness in printing occurred and it was easy to correct the plate position. Particularly good results were obtained when the occupied area percentage for the larger particles was within the range of 0.05–3.14%, since the plate offset was less than 30 μm, no unevenness in printing occurred and it was very easy to correct the plate position. One can therefore conclude that if the larger particles are used in combination with an equal amount of the smaller and less hard particles, satisfactory printing can be accomplished with a reduced number of the larger particles.

TABLE 5

| The Smaller Particles Added in Ten Volumes (Example) | | | | | | |
|---|---|---|---|---|---|---|
| Occupied area percentage | Larger Particle's diameter (μm) | | | | | |
| (%) | 3 | 5 | 20 | 40 | 50 | 60 |
| 0.03 | ×○× | Δ○× | ○○Δ | Δ○○ | Δ○○ | Δ×× |
| 0.05 | Δ○× | ◎◎◎ | ◎◎◎ | ◎◎◎ | ◎◎◎ | ○×○ |
| 0.1 | Δ○× | ◎◎◎ | ◎◎◎ | ◎◎◎ | ◎◎◎ | ○×○ |
| 1.0 | Δ○× | ◎◎◎ | ◎◎◎ | ◎◎◎ | ◎◎◎ | ○×○ |
| 2.0 | Δ○× | ◎◎◎ | ◎◎◎ | ◎◎◎ | ◎◎◎ | ○×○ |
| 3.14 | Δ○× | ◎◎◎ | ◎◎◎ | ◎◎◎ | ◎◎◎ | ○×○ |
| 4.0 | Δ○Δ | ○×○ | ○×○ | ○×○ | ○×○ | |
| 6.0 | ○ΔΔ | ○Δ○ | ○Δ○ | ○Δ○ | ○×○ | ○×○ |
| 10.0 | ×○Δ | ○×Δ | ○×○ | ○×○ | ○×○ | ○×○ |

As is clear from the data in Table 5 showing the case where the larger particles having a size of 5–50 μm were combined with ten volumes of the smaller and less hard particles, satisfactory results were obtained when the occupied area percentage for the larger particles was within the range of 0.05–4.0%, since the plate offset was no more than 50 μm, no unevenness in printing occurred and it was easy to correct the plate position. Particularly, good results were obtained when the occupied area percentage for the larger particles was within the range of 0.05–3.14%, since the plate offset was no less than 30 μm, no unevenness in printing occurred and it was very easy to correct the plate position. One can therefore conclude that if the larger particles are used in combination with ten volumes of the smaller and less hard particles, satisfactory printing can be accomplished with a reduced number of the larger particles.

The data in Tables 4 and 5 suggest that comparable results will be obtained if the smaller particles are added in amounts ranging from 1 to 10 times the amount of the larger particles.

In Comparative Examples 2-1 where the larger particles had the same Durometer hardness as the smaller particles, a plate offset greater than 100 μm occurred in all of the 2000 impressions and this result was far from being satisfactory in practical operations. After the press work, the back side of the press plate was examined but it had no dents that should have been formed by urging the camera-ready copy sheet against the plate.

In Comparative Examples 2-2 where the smaller particles were more than half the size of the larger particles, the press plate once superposed on the camera-ready copy sheet could not be easily readjusted in relative position by sliding action. In some cases, it was necessary to separate the two elements and then carefully replace one on the other in the right position but this was far from being satisfactory in practical applications.

From the foregoing results, it can be seen that prevention of plate offsets and uneven printing (smudge in the non-image area) and ease of correction of the plate position can be accomplished by a camera-ready copy sheet to be inserted between a plate cylinder and a lithographic printing plate at least the back side of which is made of a non-metallic material, said copy sheet having asperities of a predetermined shape on the front side that are urged against the back side of the lithographic printing plate to depress it, the asperities being formed of projections that consist of at least two groups of particles, characterized in that the particles of a larger size than the intermediate between maximum and minimum sizes have an average size at least twice the average size of the particles of a smaller size than said intermediate, the first group of particles having a higher hardness than the second group of particles, and the first group of particles forming projections with a height in the range of 5–50 μm.

Third Embodiment

Third embodiment will be described below with reference to the accompanying drawings.

Figure 2:
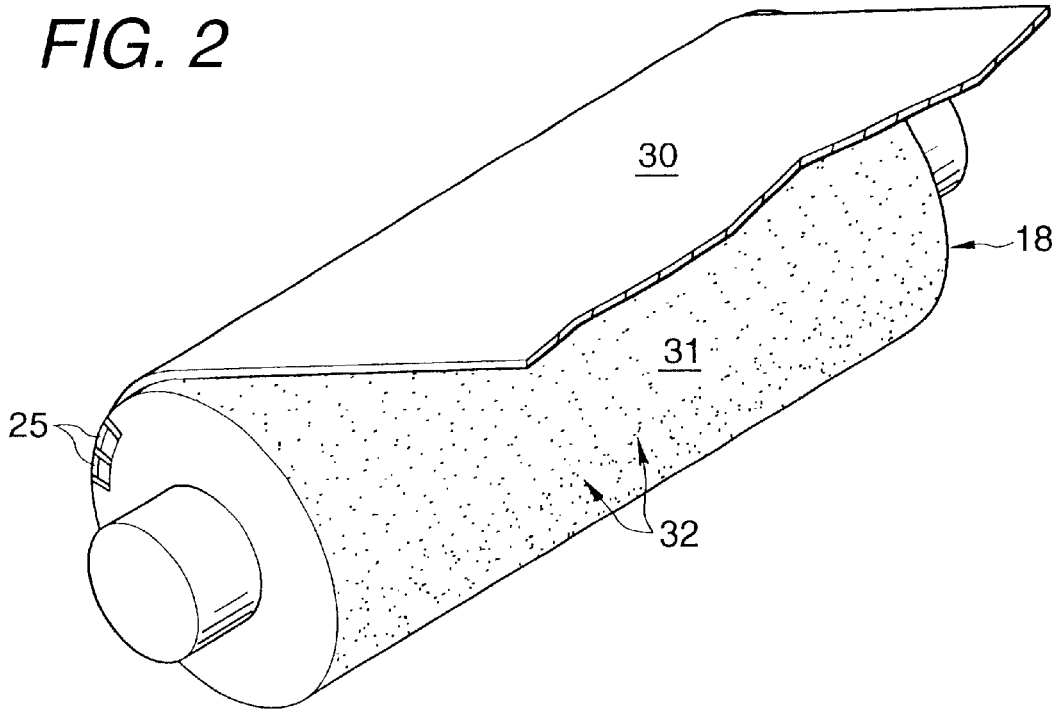
FIG. 2 is a schematic perspective view of the plate cylinder and the camera-ready copy sheet employed in the printing press shown in FIG. 1.
Figure 3:
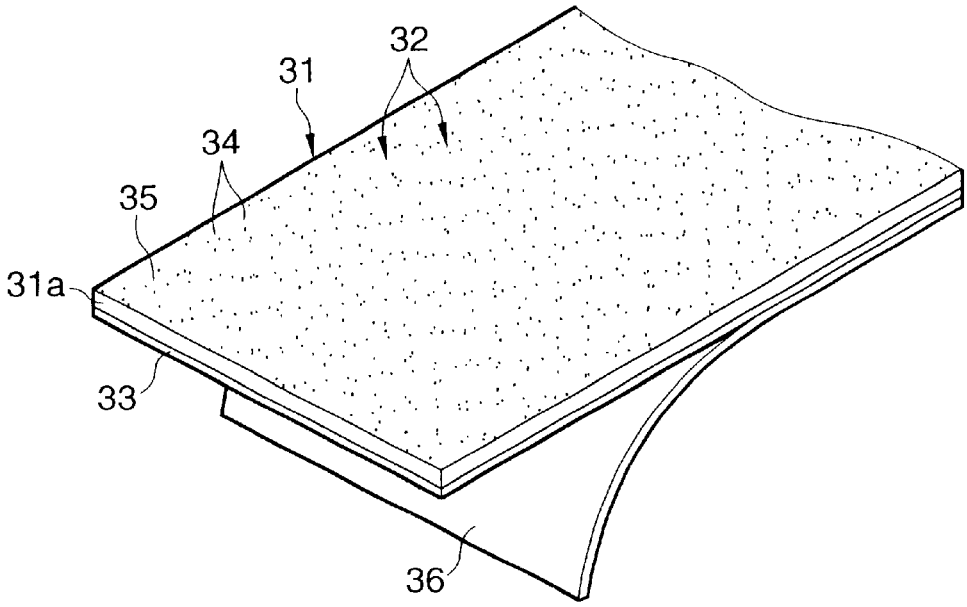
FIG. 3 is a schematic perspective view of the camera-ready copy sheet with the release layer being partly separated.

FIG. 1 is a schematic side view of a multicolor lithographic printing press employing a camera-ready copy sheet for lithographic plates according to this embodiment of the invention. FIG. 2 is a schematic perspective view of the plate cylinder and the camera-ready copy sheet employed in the printing press shown in FIG. 1. FIG. 3 is a schematic perspective view of the camera-ready copy sheet with the release layer being partly separated.

In a multicolor lithographic printing press 10 in FIG. 1, a feeder section 11 stocks sheets of paper 13 stacked on a pallet 12 and paper 13 is individually fed into a print section 14 for multicolor lithographic printing. The printed paper 13 is transported to an ejector section 15.

In the print section 14, a printing unit 16 is provided for each of black, cyan, yellow and magenta colors. Installed between adjacent printing units 16 is a sheet carrying cylinder 17 which transfers the paper 13 to the associated plate cylinder 18 so that it is printed in the desired color by a lithographic plate 30.

In each printing unit 16, the lithographic plate 30 mounted on the plate cylinder 18 is supplied with ink of a specified color from an ink supply section 19 via a multiple of inking rollers 20 so that it is deposited in the image area of the plate 30. The press plate 30 is also supplied with water from a dampening section 21 via dampening rollers 22 so that it is coated on the non-image area of the plate.

After these preparations, each press plate 30 transfers the ink from the image area onto a blanket cylinder 23 so that the paper 13 being fed between the blanket cylinder 23 and an impression cylinder 24 is printed in a specified color.

Referring to FIGS. 1 and 2, the leading edge and tail end of each press plate 30 are held by clamps 25 on the plate cylinder 18 so that it is mounted on the plate cylinder 18 in each printing unit 16, with a camera-ready copy sheet 31 for press plates (hereunder referred to simply as "camera-ready copy sheet 31") being interposed between the plate and the plate cylinder. Thus, the camera-ready copy sheet 31 for adjusting the printing pressure is provided between the back side of each press plate 30 and the circumference of the plate cylinder 18.

Referring to FIGS. 1–3, each camera-ready copy sheet 31 has asperities 32 of a predetermined shape formed on a surface of a base 31*a*. Each copy sheet 31 has glass particles 34 and a binder 35. It also has an adhesive layer 33 formed on the other surface of the base 31*a* so as to detachably adhered to the plate cylinder 18. A release layer 36 (hereinafter referred to as "release sheet 36") is provided on the side of the adhesive layer 33 to be bonded to the plate cylinder 18.

When each camera-ready copy sheet 31 is urged against the back side of the press plate 30, the surface asperities 32 are depressed into said back side. In this state, the release sheet 36 is stripped away and the adhesive layer 33 on the back side of the base 31*a* is pasted to a predetermined position on the plate cylinder 18. As a result, each camera-ready copy sheet 31 adjusts the printing pressure to be exerted by the blanket cylinder 23 and the impression cylinder 24 and, at the same time, it prevents the press plate 30 from being positionally offset on the plate cylinder 18 under pressure.

An exemplary method of forming asperities on the surface of the base of the camera-ready copy sheet is by fixing groups of particles as made from low-density polyethylene, high-density polyethylene, rubber, polystyrene, acrylic polymer, phenolic polymer, alumina, silicon carbide, corundum, diamond grit and glass, in which a group of particles having a larger size than the intermediate between maximum and minimum sizes have an average size at least twice the average size of a group of particles having a smaller size than the intermediate.

For example, specific method of forming asperities on the surface of the copy sheet are as follows: a dispersion of the particles in a binder is applied to the base and then dried; after a binder film is formed; the particles are pushed into the film under mechanical pressure; and the particles are electrodeposited after the binder film was formed.

The camera-ready copy sheet of the present invention can use any base materials that have good fit to the plate cylinder, as exemplified by plastics (e.g. polyethylene terephthalate, polypropylene and polyethylene), metals (e.g. aluminum and SUS), paper (e.g. natural or synthetic paper), and cloths.

The camera-ready copy sheet can be fixed to the plate cylinder by means of an adhesive layer that is provided on the back side of the copy sheet. The adhesive layer may be formed of any suitable adhesive such as sprayed glue or double-coated tape.

The adhesive is mainly composed of an elastomer which is a polymeric material that exhibits rubber-like elasticity to undergo agglomeration at ordinary temperatures. Specific and preferred examples are polymers including polyisoprenes (both natural and synthetic), styrene-butadiene rubbers (SBR), thermoplastic rubbers (SBS and SIS), butyl rubbers, polyisobutylenes, chloroprene rubbers, silicone rubbers, regenerated rubbers, various polyacrylate esters and polyvinyl ethers.

The release sheet 36 of the camera-ready copy sheet 31 is formed on the base in sheet form by applying a release agent in an amount of 0.04–0.1 g/m$^2$ to a thickness of about several micrometers.

Exemplary release agents include a copolymer having a long-chain alkyl group, a long-chain alkylated natural or synthetic polymer, a perfluoroalkyl containing compound, silicon and other metal containing substances, and a less adhesive polymer containing no long-chain alkyl group. These compounds are used either individually or in admixture or incorporated in a binder polymer before application to the base.

Alternatively, both the leading edge and the tail end of the copy sheet may be brought into direct engagement with clamps in the surface of the plate cylinder. If desired, this method may be combined with the provision of the adhesive layer on the camera-ready copy sheet.

We now describe the manner of carrying out the invention in the mode under consideration. Before printing on a lithographic press, the respective plates are mounted on the plate cylinders in the associated printing units with the camera-ready copy sheet interposed. Each of the intervening copy sheets is urged against the back side of the press plate, whereupon the viscoelasticity of the larger particles bring the camera-ready copy sheet into intimate contact with the back side of the plate. In consequence, each copy sheet not only adjusts the printing pressure being exerted by the blanket cylinder and the impression cylinder but also prevents positional offset of the press plate on the plate cylinder under pressure.

We next describe the method of preventing positional offset of the press plate. The camera-ready copy sheet having asperities of a predetermined shape formed on the surface of the plate base is interposed between the plate and the plate cylinder in each printing unit in such a way that the frictional force being exerted by the projections on the surface of each camera-ready copy sheet effectively works to prevent plate offset.

Due to the viscoelasticity of the larger particles formed on the surface of the camera-ready copy sheet, "blocking" may occur if a multiple of camera-ready copy sheets are stacked. To avoid this problem, each camera-ready copy sheet may be covered with a release sheet such as a siliconized sheet.

EXAMPLE 3

Samples of the camera-ready copy sheet according to the third embodiment of the invention and samples having asperities formed under conditions outside the scope of the present invention were set on a lithographic press and printing was performed to evaluate the positional offset that occurred to the press plate on the plate cylinder. The specific conditions for copy sheet preparation and presswork and their results are set forth below.

Examples

The surface of a polyethylene terephthalate (PET) base 100 μm thick was roller coated with a homogenized dispersion of the recipe indicated below. Low-density polyethylene beads having Durometer hardness values of 58, 60 and 65 (Sumitomo Seika Chemicals Co., Ltd.; FLOW BEADS LE-1080, FLOW BEADS CL-2507 and FLOW BEADS CL-2080, respectively) were classified to a size range of 3–300 μm with a powder centrifuge to give the larger particles.

In a separate step, glass beads having a Durometer hardness of 100 or more (GB 731 of Toshiba Glass Co., Ltd.) were classified with a powder centrifuge to a size range of 1.5–100 μm to give the smaller particles.

At the time of mixing, the larger particles having average sizes in the stated range were so formulated as to provide an occupied area percentage of 1.5% and then the smaller particles were added to each formulation and sonicated to prepare a paint. An acrylic resin was used as a binder. The smaller particles were so formulated as to provide an occupied area percentage of 3.0%.

| Low-density polyethylene: Larger particles (Average diameter) | X (g) |
|---|---|
| 3 μm | 0.10 g |
| 5 μm | 0.11 g |
| 45 μm | 0.17 g |
| 105 μm | 0.20 g |
| 190 μm | 0.22 g |
| 290 μm | 0.31 g |
| Glass beads: Smaller particles Mixed in equal amount to X (Example) | |
| 1.5 μm | 0.21 g |
| 20 μm | 0.50 g |
| 30 μm | 0.62 g |
| 42 μm | 0.73 g |
| 100 μm | 0.82 g |
| Acrylic resin (40% in toluene) | 20 g |
| Toluene | 80 g |

The press plate was prepared by a dedicated platemaker SPM 415 from Super Master Plus of AGFA-Gevaert AG which was a silver diffusion type light-sensitive material using a PET base 100 μm thick. The plate had a total thickness of 130 μm. The press plate may be replaced by a PS plate having an image-receiving layer on a non-metallic base or an electrophotographically made plate.

The copy sheet and the press plate were each cut to a width of 560 mm and a length of 400 mm and placed one on the other so that the roughened surface of the copy sheet was in contact with the back side of the press plate. The assembly was mounted on the plate cylinder of Oliver 52 (non-perfecting or one-side printing press of Sakurai Co., Ltd.) to print ruled lines on 2000 sheets of paper.

Prior to printing, the surface of the press plate was squeegeed with sponge impregnated with processing solution G671c. The dampening water on the press was a 1:1 aqueous dilution of G671c. The ink was New Champion F Gloss 85 of DAINIPPON INK AND CHEMICALS, INC.

The initial positions of the ruled lines were compared with those on the last printed paper to evaluate the positional offset that had occurred to the press plate on the plate cylinder during 2000 impressions.

The data in table 6 were obtained by the following criteria for evaluation.

(Evaluation Criteria)

Plate offset: ○ (<50 m), Δ (50 μm to less than 100 μm), × (≧100 μm)

Uneven printing: ○ (no unevenness), Δ (limited unevenness), × (extensive unevenness)

The unevenness in printing that was evaluated on the printed matter in addition to the plate offset may reasonably be taken to occur by the following mechanism: any coarse particles on the copy sheet interposed between the press plate and the plate cylinder deform the soft plate base material such as PET during printing so that the surface of the deformed area of the press plate is raised to cause scumming in spots, which is recognized as "uneven prints" on the printed matter. In the above Examples, the larger particles were soft enough with a Durometer hardness of no more than 65 but as their size increased, they would have deformed the PET film to cause uneven prints.

TABLE 6

| | Average diameter of smaller particles (μm) | Average diameter of larger particles (μm) | Durometer hardness of larger particles | Plate offset | Uneven print |
|---|---|---|---|---|---|
| Example 3-1 | 1.5 | 5 | 58 | ○ | ○ |
| Example 3-2 | 20 | 45 | 60 | ○ | ○ |
| Example 3-3 | 42 | 105 | 65 | ○ | ○ |
| Example 3-4 | 42 | 190 | 65 | ○ | ○ |
| Comparative Example 3-1 | 20 | 45 | 75 | × | Δ |
| Comparative Example 3-2 | 42 | 190 | 75 | Δ | × |
| Comparative Example 3-3 | 30 | 45 | 60 | Δ | ○ |
| Comparative Example 3-4 | 100 | 190 | 65 | Δ | ○ |
| Comparative Example 3-5 | 1.5 | 3 | 58 | × | ○ |
| Comparative Example 3-6 | 42 | 290 | 65 | ○ | × |

Comparative Examples 3-1~3-6

Six samples of camera-ready copy sheet were fabricated as in the above Examples, except that the particles of which the projections were made were changed as follows: high-density polyethylene beads having average sizes of 45 μm and 190 μm (FLOW BEADS HE-5023 of Sumitomo Seika Chemicals Co., Ltd. with a Durometer hardness of 75) were used as the larger particles Comparative Examples 3-1 and 3-2); glass beads having average sizes of 30 μm and 100 μm (Durometer hardness in excess of 100) were used as the smaller particles (Comparative Examples 3-3 and 3-4); low-density polyethylene beads having an average size of 3 μm (Durometer hardness of 58) were used as the larger particles (Comparative Example 3-5); and low-density polyethylene beads having an average size of 290 μm (Durometer hardness of 65) were used as the larger particles (Comparative Example 3-6). The thus fabricated camera-ready copy sheets were subjected to presswork on the same press with the same plate as in the above Examples to produce 2000 impressions.

The results of evaluation are shown in Table 6. The data for Examples of the present invention are bounded by a rectangle in thick lines.

As is clear from the data shown in Table 6, extremely good results were obtained in terms of protection against both plate offset and uneven print when the average size of the larger particles was at least twice that of the smaller particles, the larger particles had a Durometer hardness of no more than 65 which was lower than that of the smaller particles, and the larger particles formed projections with a height in the range of 5–200 μm. One can therefore conclude that satisfactory printing can be done if the average size of the larger particles is at least twice that of the smaller particles, the larger particles have a Durometer hardness of no more than 65 which is lower than that of the smaller particles, and the larger particles form projections with a height in the range of 5–200 μm.

On the other hand, the results of Comparative Examples 3-1 and 3-2 show that the larger particles which were at least twice as large as the smaller particles but which had a Durometer hardness greater than 65 caused plate offset and uneven print, thereby precluding the chance of performing satisfactory printing.

The results of Comparative Examples 3-3 and 3-4 show that even when the larger particles had a Durometer hardness of no more than 65 which was lower than the Durometer hardness of the smaller particles, the smaller particles which were more than half the size of the larger particles caused a plate offset in excess of 50 μm, thereby precluding the chance of performing satisfactory printing.

The results of Comparative Examples 3-5 and 3-6 show that even when the average size of the smaller particles was no more than one half the average size of the larger particles and although the larger particles had a Durometer hardness of no more than 65 which was lower than the Durometer hardness of the smaller particles, the larger particles having an average size of less than 5 μm caused a plate offset in excess of 100 μm whereas the larger particles having an average size greater than 200 μm caused too much unevenness in print to achieve satisfactory printing.

Additional camera-ready copy sheets were fabricated by using the following four kinds of particles individually as the "larger particles" in Table 6: (1) particles with a Durometer hardness of 58 and a size of 5 μm; (2) particles with a Durometer hardness of 60 and a size of 45 μm; (3) particles with a Durometer hardness of 65 and a size of 105 μm; (4) particles with a Durometer hardness of 65 and a size of 190 μm. Compared to the camera-ready copy sheets using the soft larger particles in combination with the hard smaller particles, it was not easy to correct the distortion between the press plate and the copy sheet and make positional adjustments both prior to and during presswork. The camera-ready copy sheet using the larger particles (1) was particularly problematic since it had the additional problem of "blocking" and it was difficult to separate adjacent copy sheets in a stack.

In another experiment, camera-ready copy sheets were fabricated with the occupied area percentage for the larger particles being changed in Example 3-1 (the smaller particles having an average size of 1.5 μm and the larger particles having an average size of 5 μm and a Durometer hardness of 58) and Example 3-4 (the smaller particles having an average size of 42 μm and the larger particles having an average size of 190 μm and a Durometer hardness of 65). The other process conditions were the same as in Examples 3-1 and 3-4.

When the larger particles occupied less than 0.1% of the unit area, the plate offset that occurred after printing 2000 sheets under the same conditions as in Example 2 was no more than 50 μm. When the occupied area percentage for the larger particles was within the range of 0.1–4.0%, the plate offset was negligible and less than 50 μm. If the larger particles occupied more than 4.0% of the unit area, slight unevenness occurred in the printed matter; on the other hand, uneven printing hardly occurred when the occupied area percentage for the larger particles was within the range of 0.1–4.0%. When 10000 impressions were made under the same conditions, a plate offset in excess of 50 μm occurred from the larger particles occupying less than 0.1% of the unit area and distinct unevenness in printing, occurred from the larger particles occupying more than 4.0% of the unit area. However, the occurrence of uneven printing was still negligible when the larger particles occupied 0.1– 4.0% of the unit area. One can therefore conclude that extremely satisfactory printing can be accomplished by allowing the larger particles to occupy 0.1–4.0% of the unit area.

According to the invention, plate offset and uneven printing can be prevented to ensure satisfactory printing by using a camera-ready copy sheet to be inserted between a plate cylinder and a lithographic printing plate, said copy sheet having asperities of a predetermined shape on the front side, the asperities being formed of projections that consist of at least two groups of particles, characterized in that the particles of a larger size than the intermediate between maximum and minimum sizes have an average size at least twice the average size of the particles of a smaller size than said intermediate, the first group of particles having a Durometer hardness of no more than 65 which is lower than that of the second group of particles, and the first group of particles forming projections with a height in the range of 5–200 μm.

What is claimed is:

1. A camera-ready copy sheet to be inserted between a plate cylinder and a lithographic printing plate at least the back side of which is made of a non-metallic material, said copy sheet having asperities of a predetermined shape on the front side that are urged against the back side of the lithographic printing plate to depress it, the asperities being formed of projections that consist of at least two groups of particles;

wherein a larger particle group having a particle size larger than an intermediate between maximum and minimum sizes have an average size at least twice an average size of particles of a smaller particle group having a particle size smaller than said intermediate, the larger particle group have a higher hardness than the smaller particle group, and the larger particle group forms projections with a height in the range of 5 to 50 μm.

2. The camera-ready copy sheet according to claim 1, wherein an amount of the smaller particles as relative to the larger particles is in the range of ½ to 1000 times.

3. The camera-ready copy sheet according to claim 2, wherein an amount of the smaller particles as relative to the larger particles is in the range of 1 to 200 times.

4. The camera-ready copy sheet according to claim 3, wherein an amount of the smaller particles as relative to the larger particles is in the range of 1 to 25 times.

* * * * *